United States Patent [19]

Sieverman

[11] Patent Number: 4,812,131

[45] Date of Patent: Mar. 14, 1989

[54] ELECTRICAL PLUG LOCK APPARATUS

[76] Inventor: Terry L. Sieverman, 12 N. Sherry La., Bellevue, Ky. 41073

[21] Appl. No.: 172,162

[22] Filed: Mar. 23, 1988

[51] Int. Cl.[4] ..... H01R 13/44

[52] U.S. Cl. ..... 439/134; 439/133; 439/304

[58] Field of Search ..... 439/133, 134, 304

[56] References Cited

U.S. PATENT DOCUMENTS

| | | | |
|---|---|---|---|
| 4,407,554 | 10/1983 | Drall | 339/37 |
| 4,413,488 | 11/1983 | Harmison, Jr. | 70/57 |
| 4,445,738 | 5/1984 | Wiencke | 339/37 |
| 4,640,107 | 2/1987 | Slade | 439/133 |
| 4,673,230 | 6/1987 | Baumgart | 439/133 |
| 4,679,873 | 7/1987 | Brackett, Jr. | 439/134 |

*Primary Examiner*—Paula A. Austin Bradley
*Attorney, Agent, or Firm*—Henderson & Sturm

[57] ABSTRACT

A lock apparatus (10) for an electrical plug (100) wherein the lock apparatus comprises a housing unit (11) provided with an elongated slot (25') and containing a key actuated lock mechanism (70) which cooperates with a plug capturing member (80) which is slideably disposed in the elongated slot (25'); wherein, the capturing member (80) is provided with capturing arms (83) which are adapted to engage the rear of the electrical plug (100).

5 Claims, 1 Drawing Sheet

FIG. 1.
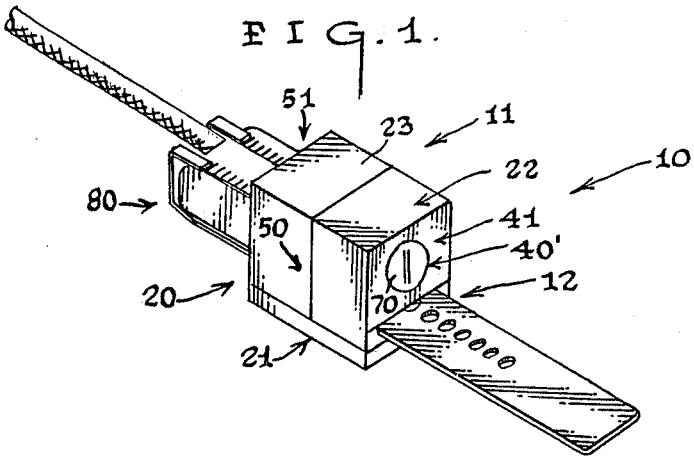
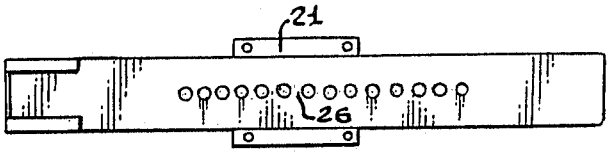
FIG. 2.
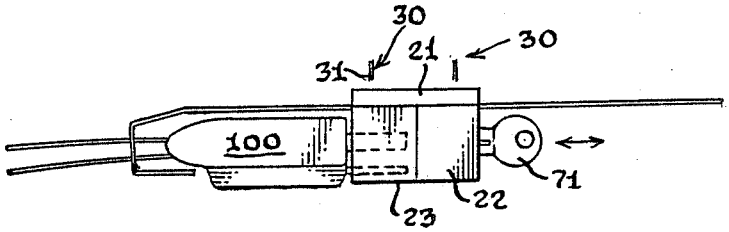
FIG. 3.
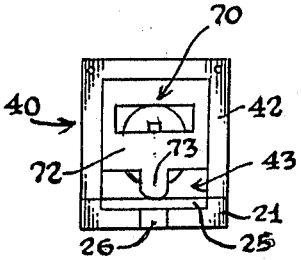
FIG. 5.
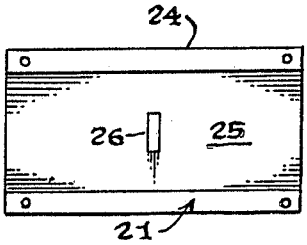
FIG. 4.
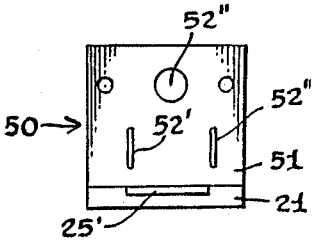
FIG. 6.

ELECTRICAL PLUG LOCK APPARATUS

TECHNICAL FIELD

The present invention relates generally to the field of electrical plug safety devices and more specifically to a locking device that will captively surround the prongs of an electrical plug.

BACKGROUND OF THE INVENTION

As can be seen by reference to the following U.S. Pat. Nos.: 4,407,554; 4,673,230; 4,413,488; and 4,445,738 the prior art is replete with myriad and diverse electrical plug securing mechanisms.

These prior art constructions all have as their main purpose and function the prevention of the unauthorized use by children or others of the equipment, implement or fixture to which the electrical plug is attached. In the case of children a plug security device is desirable to prevent the child from receiving an electrical shock due to improper handling of the prongs of the plug during the insertion of the plug into an electrical receptacle or outlet; and, in the case of both children and adults, an electrical plug security device is desirable to prevent a person from operating a given electrically driven item for a variety of valid reasons.

While all of the aforementioned prior art constructions are more than adequate for the basic function and purpose for which they were specifically designed, these patented structures are also uniformly deficient in their inability to adjustably engage both the front and rear of the plug body, while also securely surrounding the forwardly projecting prong elements of the plug body.

There has obviously existed a longstanding need among those individuals who regularly use these devices for a plug security device that would fulfill the aforementioned functional parameters; and, the electrical plug lock apparatus that forms the basis of the present invention was specifically developed with those goals in mind.

BRIEF SUMMARY OF THE INVENTION

Briefly stated, the electrical plug lock apparatus that forms the basis of the present invention comprises in general: a housing unit, and a locking unit which is associated with the housing unit such that the locking unit may be brought into engagement with the rear of an electrical plug member while the face of the plug member is in an abutting relationship with the housing unit.

The locking unit comprises in general: a key actuated lock member that cooperates with a bifurcated capture member, wherein the lock member is disposed within the housnng, and the capture member is disposed in a reciprocating relationship relative to the housing member. This selectively reciprocating relationship between the capture member and the housing unit allows an electrical plug member to matingly engage with suitably dimensioned socket apertures in the housing unit by virtue of an outward translation or extension of the capture member; whereupon, an inward translation or retraction of the capture member will bring the capture member into engagement with the rear of the electrical plug member.

Actuation of the key actuated lock member will then secure the capture member in a fixed position relative to both the housing unit and the plug member; wherein the prongs of the electrical plug member will be encased and surrounded in a mating relationship with the housing unit.

By virtue of the structural cooperation between the various components of the aforementioned electrical plug lock apparatus; different length plug members of both the two and three pronged variety may be safely and securely retained with in the apparatus in a quick, simple and efficient manner.

BRIEF DESCRIPTION OF THE DRAWINGS

These and other objects, advantages and novel features of the invention will become apparent from the detailed description of the best mode for carrying out the preferred embodiment of the invention which follows; particularly when considered in conjunction with the accompanying drawings, wherein:

FIG. 1 is a perspective view of the lock apparatus in engagement with an electrical plug;

FIG. 2 is a top plan view of the capture member and a portion of the housing unit;

FIG. 3 is an inverted side plan view of the lock apparatus and an electrical plug;

FIG. 4 is a top plan view of the base of the housing unit;

FIG. 5 is a front plan view of the key actuated lock member; and,

FIG. 6 is a front plan view of the plug receiving face of the housing unit.

BEST MODE FOR CARRYING OUT THE INVENTION

As can be seen by reference to the drawings and in particular to FIG. 1, the electrical plug lock apparatus that forms the basis of the present invention is designated generally by the reference numeral (10). The lock apparatus (10) comprises in general: a housing unit (11) and a locking unit (12 . These units will now be described in seriatim fashion.

As shown in FIG. 1, the housing unit (11) comprises in general: a generally rectangular housing member (20) including a lower base portion (21), an upper lock receiving portion (22), and an upper plug receiving portion (23) which are joined together by suitable fastening means (30) such as threaded screws (31), or the like, as depicted in FIG. 3.

Turning now to FIGS. 2 thru 4, it can be seen that the base portion (21 of the housing member (20) comprises a generally flat elongated rectangular element (24) having an elongated shallow recess (25) extending along the axial length of the base portion (21), which is further provided with a centrally disposed aperture (26), whose purpose and function will be explained in greater detail further on in the specification.

As can be seen by reference to FIGS. 1, 3, and 5, the lock receiving portion (22) of the housing member (20) comprises a first generally square housing element (40) having an enlarged axial bore (40') extending from the front face (41) of the first housing element (40) to the rear face (42) of the first housing element (40). In addition, the rear (42) of the first housing element (40) is provided with a vertically disposed shallow recess (43) wherein the axial bore (40') and the shallow recess (43) are dimensioned to receive portions of the locking unit (12).

As shown in FIGS. 1, 3, and 6, the plug receiving portion (23) of the housing member (20) comprises a second generally square housing element (50); wherein, the rear face (51) of the housing element (50) is provided with a plurality of elongated apertures (52) which are dimensioned to receive the prongs (shown in phantom) of a conventional electrical plug (100). As shown particularly in FIG. 6, the apertures (52) comprise a pair of generally elongated apertures (52') that accept the prongs of a two pronged plug (100) as well as a generally circular aperture (52'') for a grounded three pronged plug (100).

It can also be appreciated by reference to FIGS. 5 and 6, that the elongated recess (25) in the base portion (21) of the housing member (20) cooperates with the bottom of both the lock receiving portion (22) and the plug receiving portion (23) to provide an elongated generally rectangular slot (25') that extends along the length of the body unit (11).

Turning now to FIGS. 1 thru 4, it can be seen that the locking unit (12) comprises a key actuated lock mechanism (70), which is dimensioned to be received in the lock receiving portion (22) of the housing member (20), and a plug capturing member (80) which is dimensioned to be slideably received in the recess (25) in the base portion (21) of the housing member (20).

The key actuated locking mechanism (70) of this invention comprises a conventional rotary cylinder lock which is controlled by a suitable key (71) and further includes a reciprocating latch plate (72) having a downwardly depending latch detent (73) which is dimensioned to be received in the central aperture (26) of the base portion (21) of the housing member. In addition, the reciprocating latch plate (72) is further dimensioned to be slideably received in the vertically disposed shallow recess (43) in the rear face (42) of the lock receiving portion (22) of the housing member.

Turning now to FIGS. 1 thru 3, it can be seen that the plug capture member (80) includes an elongated generally flat rectangular male stem element (81) having a plurality of apertures (82) disposed along its longitudinal axis. In addition, one end of the stem element (81) is bifurcated into two upwardly and inwardly angled capture arms (83); wherein, the space (84) between the capture arms (83) is dimensioned to accommodate the passage of the electrical cord (101) of a conventional electrical plug (100), while preventing the passage of the body of the electrical plug (100).

By now it should be appreciated that the electrical plug lock apparatus (10) that forms the basis of the present invention operates in the following manner. First of all, in order to effect the insertion of the plug body (100) into the apparatus (10) the male stem element (81) of the capture member (80) must be retracted thru the slot (25') away from the housing unit (11) to allow the passage of the electrical plug body (100) over the inboard ends of the capture arms (83), such that the electrical cord (101) is disposed in the space (84) between the capture arms (83). At this juncture the prongs of the electrical plug (100) are inserted into the apertures (52) in the upper plug receiving portion (23) of the housing unit (11). Whereupon, the male stem element (81) is withdrawn through the slot (25') in the housing unit (11) to bring the capture arms (83) into close proximity with the rear surface of the electrical plug (100).

Once the capture arms (83) are situated in the aforementioned proximity to the electrical plug (100) one or more of the plurality of apertures (82) in the male stem element (81) will be either in alignment with, or slightly offset from the centrally disposed aperture (26) in the base portion (21) and the latch detent (73) of the lock receiving portion (22) of the housing. When alignment between a given one of the plurality of apertures (82) the latch detent (73) and the aforementioned central aperture (26) is achieved, the key (71) may be actuated to bring the latch detent (73) through the given aperture (82) and the central aperture (26) the electrical plug (100) will be securely retained within the electrical plug lock apparatus (10).

Having thereby described the subject matter of this invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A lock apparatus for use in combination with an electrical cord and a plug having prongs wherein the lock apparatus comprises:

a housing unit comprising a generally rectangular housing member including a lower base portion; an upper plug receiving portion; an upper lock receiving portion; and, an elongated generally rectangular slot which extends through said housing member; and, a locking unit comprising a key actuated locking mechanism which is disposed in the upper lock receiving portion of the housing unit and provided with a latch detent that is adapted to extend into said generally elongated rectangular slot in the housing unit; and, a plug capture member including an elongated male stem element that is dimensioned to be slideably received within said generally rectangular slot wherein one end of the male stem element is provided with a pair of capture arms which are adapted to engage the rear of the electrical plug.

2. The lock apparatus as in claim 1 wherein said male stem element is provided with a plurality of apertures along its longitudinal axis wherein each of said plurality of apertures are dimensioned to receive the latch detent of the key actuated locking mechanism.

3. The lock apparatus as in claim 2 wherein the upper plug receiving portion of said housing unit is provided with a plurality of apertures that are dimensioned to receive the prongs of said plug.

4. The lock apparatus as in claim 3 wherein the generally elongated slot in the housing unit is further provided with an aperture that is positioned beneath and dimensioned to receive said detent latch of the key actuated locking mechanism.

5. The lock apparatus as in claim 4 wherein the capture arms of said plug capture member form a space that is dimensioned to accommodate the passage of the electrical cord and prevent the passage of the electrical plug.

* * * * *